US005273332A

United States Patent [19]

Currie

[11] Patent Number: 5,273,332

[45] Date of Patent: Dec. 28, 1993

[54] TOP SIDE TRANSMISSION LIFT

[76] Inventor: Michael D. Currie, 6426 Penrith Dr., Mechanicsville, Va. 23111

[21] Appl. No.: 882,425

[22] Filed: May 13, 1992

[51] Int. Cl.[5] ..... B66C 13/08

[52] U.S. Cl. ..... 294/67.5; 294/81.4

[58] Field of Search ..... 294/67.1, 67.21, 67.5, 294/81.1, 81.3, 81.4, 81.56, 82.12, 86.41; 212/217, 225-228

[56] References Cited

U.S. PATENT DOCUMENTS

| | | | |
|---|---|---|---|
| 246,732 | 9/1881 | Davy | 212/227 |
| 2,478,513 | 8/1949 | TeDesco | 294/67.1 X |
| 3,314,711 | 4/1967 | Dietz et al. | 294/67.5 |
| 3,561,810 | 2/1971 | Newsted | 294/81.3 |
| 3,805,967 | 4/1974 | Scannell | 212/217 |
| 3,955,844 | 5/1976 | de Castella et al. | 294/67.5 X |
| 3,976,202 | 8/1976 | Bauvin | 212/217 |
| 4,002,243 | 1/1977 | Kramer | 212/225 |
| 4,648,647 | 3/1987 | Patton | 294/67.1 |
| 4,930,970 | 6/1990 | Sunderland | 212/227 X |

FOREIGN PATENT DOCUMENTS

| | | | |
|---|---|---|---|
| 2529068 | 1/1977 | Fed. Rep. of Germany | 294/81.3 |
| 3510894 | 10/1986 | Fed. Rep. of Germany | 294/67.5 |
| 1022935 | 6/1983 | U.S.S.R. | 294/67.5 |
| 1120049 | 7/1968 | United Kingdom | 294/81.3 |
| 1159560 | 7/1969 | United Kingdom | 294/81.3 |

*Primary Examiner*—Johnny D. Cherry
*Attorney, Agent, or Firm*—Sheldon H. Parker

[57] ABSTRACT

A lifting device predominantly for use with lifting transmissions from vehicles includes a polygon shaped rail with a U shaped brace at one end and a U shaped chain support at the other end. A movable lifting unit has two panels straddling the rail and a pair of rollers in contact with the rail. A pulley system with a slidable hook is secured to the lifting device. The movable lifting unit is placed over the item to be removed, lifted through use of the pulley system and then rolled out of the way.

20 Claims, 6 Drawing Sheets

TOP SIDE TRANSMISSION LIFT

BACKGROUND OF THE INVENTION

1. Field of the Invention

The instant device relates to an improved transmission lift for body lift garbage trucks.

2. Background of the Prior Art

Body lift garbage trucks are commonly used in communities throughout the U.S. for refuse collection. Since the average price of each truck is $250,000, communities do not purchase more than they require. The minimum number of trucks are purchased and scheduled for the maximum number of pick ups. Therefore, when the clutch on the trucks breaks down, which occurs about every six to nine months, the "down time" must be as short as possible.

The average clutch repair time of the body lift trucks is 10–15 hours. This places a truck out of commission for up to two days, costing the city overtime in manpower. The lift of the instant invention enables the body lift transmissions to be removed and repaired in approximately one third to one half the time normally required. This allows for truck repair in approximately one day versus two.

SUMMARY OF THE INVENTION

A lifting device is disclosed having a steel polygon rail with a U shaped brace at one end and a U shaped chain support at the other end. The U shaped chain support has a chain with an attachment device at one end to connect the chain into a loop. A movable lifting unit, having two panels kept spaced at the desired width by braces, straddles the rail. The movable lifting unit is prevented from inadvertent removal from the rail by bolts, or other means, placed through the panels under the rail. A pair of rollers within the lifting unit keep the lifting unit in movable contact with the rail. A pulley system is attached to the movable lifting unit and is provided with a free moving hook running on wire which interacts with the pulley system. The pulley system has a load lift capacity of at least 1000 pounds. The lifting device is secured to a supporting device by the U shaped brace and the chain and the movable lifting unit is placed over the item to be lifted. The item is lifted through use of the pulley system.

BRIEF DESCRIPTION OF THE DRAWINGS

The objects of the invention and features of the present disclosure will more fully become apparent from the following detailed description when taken in connection with the drawings, wherein.

DETAILED DESCRIPTION OF THE INVENTION

Figure 1:
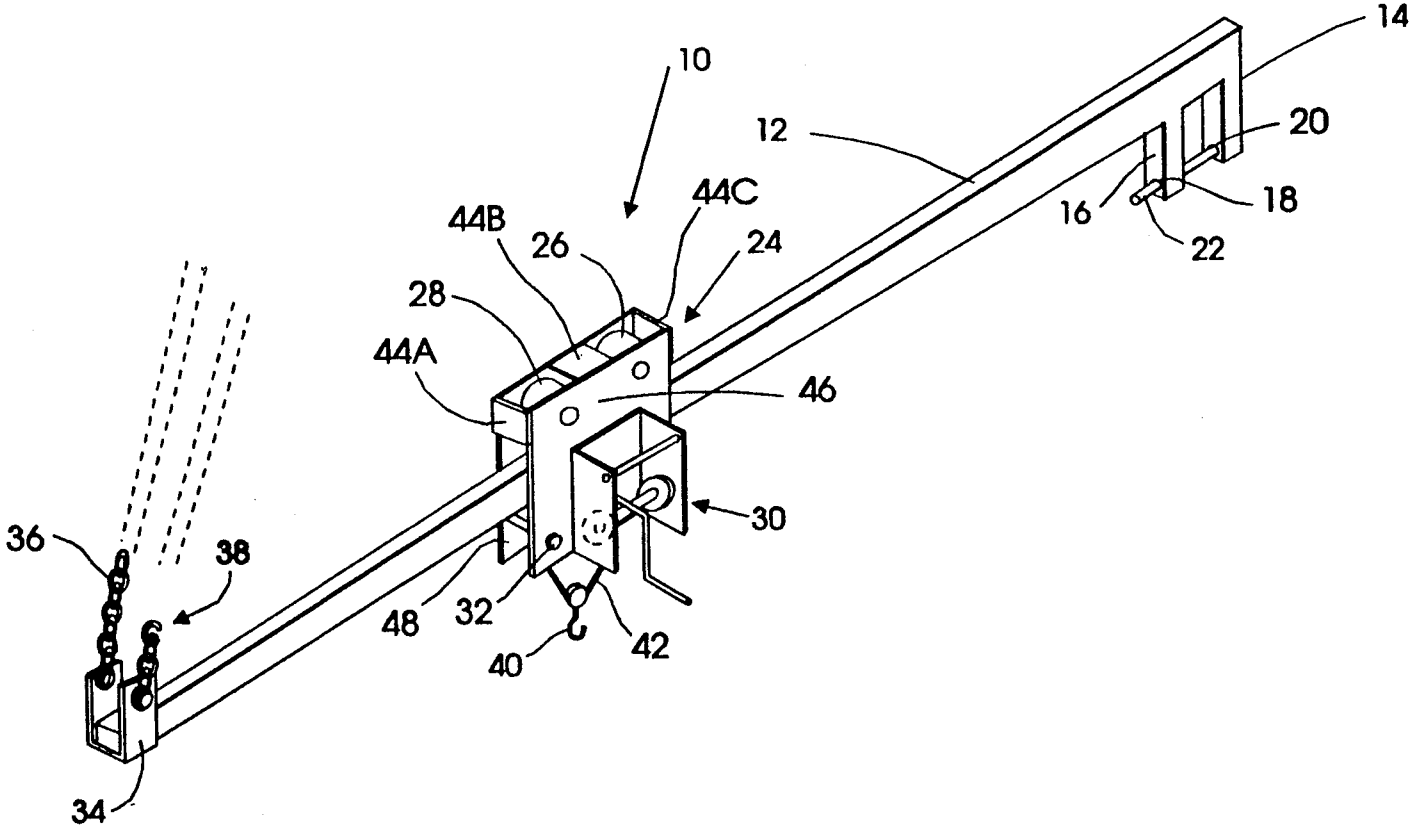
FIG. 1 is a perspective view of the instant disclosure.
Figure 7:
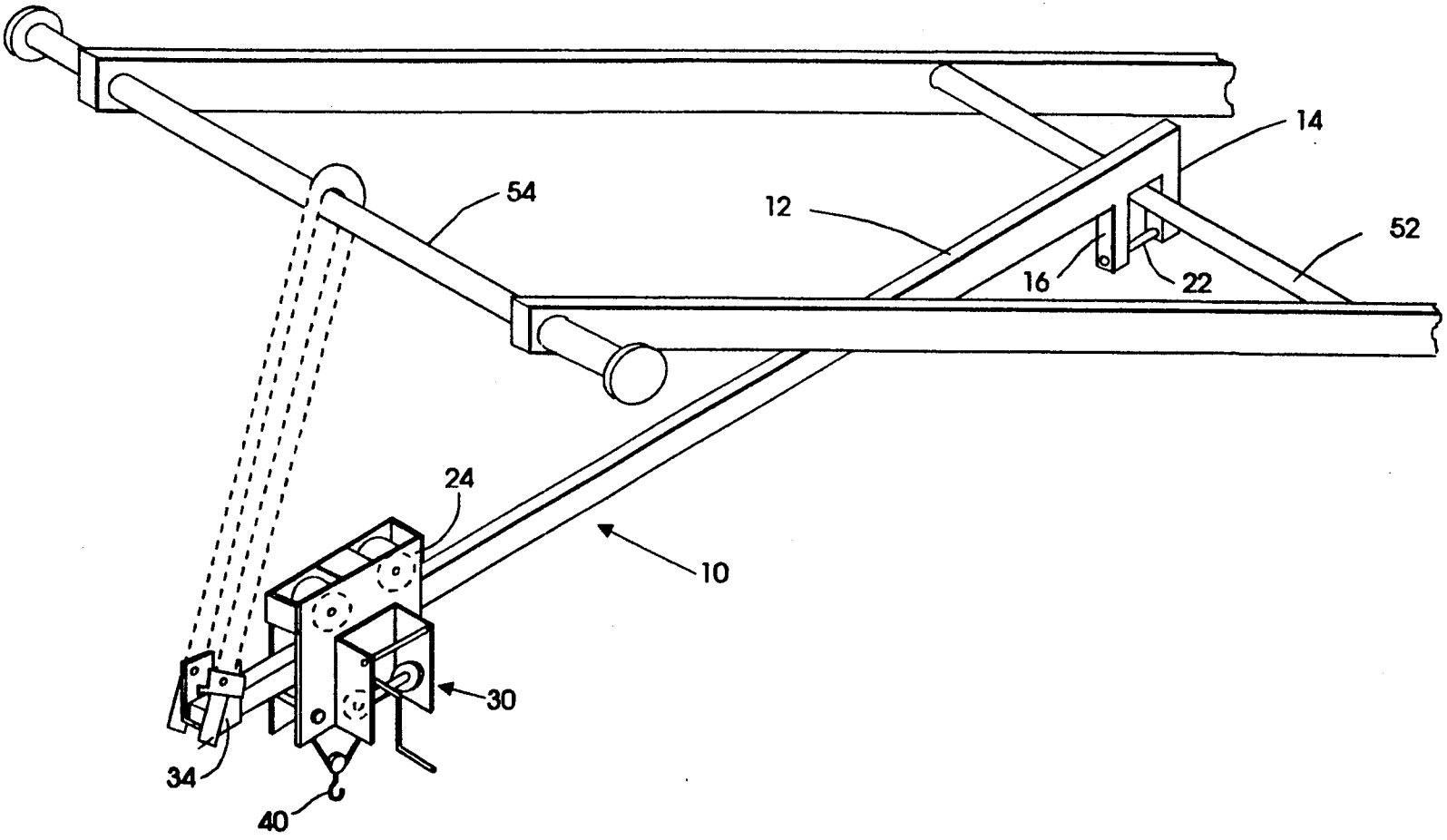
FIG. 7 is a perspective view of an alternate support for the device of FIG. 1.
Figure 8:
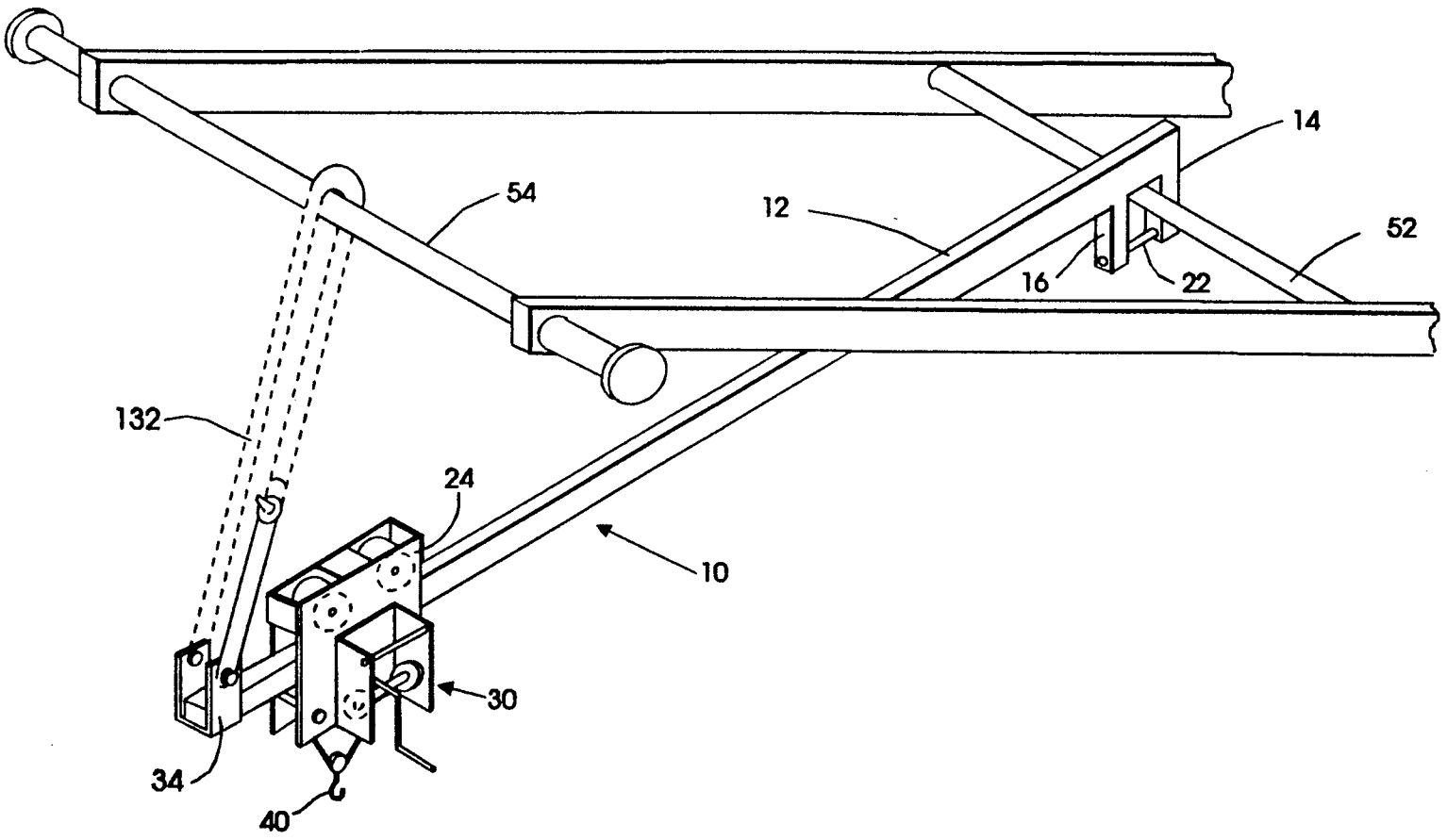
FIG. 8 is a perspective view of an alternate support for the device of FIG. 1.

FIG. 1 illustrates the transmission lift 10 of the instant invention. The rail 12 is manufactured from rigid steel, preferably 3/16 or heavier, or any other material which will provide the rigidity and strength required, and is approximately 6 feet 2 inches long and two inches square. This dimension is applicable for the body lift trucks; however, the length dimension can be altered depending upon application. One end of the rail 12 is provided with a U shaped locking support comprising end support 14 and accompanying support 16. The accompanying support 16 has a hole 18 drilled through the unconnected end. The end support 14 is provided with a hole 20 drilled at least partially through. The length of the supports 14 and 16 from the rail 12 is preferably three inches. Although the length can vary, it must be sufficient to extend beyond the truck brace and allow for insertion of the pin 22. The supports 14 and 16 must be spaced so as to maintain a distance between them of sufficient width to fit over the truck brace. The pin 22 is used to secure the transmission lift 10 to the truck brace, as described further in FIG. 2. The hole 20 can be drilled completely through the end support 14 with the pin 22 being prevented from removal through use of a nut. As an alternative, the end support 14 can be threaded to receive the threaded end of the pin 22. Other means can be used to retain the pin 22 in position, as well known in the prior art. The panels 46 and 48 of the lift box 24 straddle the rail 12 and support the pulley mechanism 30. The lift box 24 is provided with rollers 26 and 28 which rest on the top of the rail 12 and allow for easy movement of the lift box 24. The lift box 24 is held rigid by braces 44*a*, 44*b* and 44*c* which hold the panels 46 and 48 in place. The braces 44*a*, 44*b* and 44*c* are of a length to easily fit over the rail 12 while not being so large as to rock. A length of $2\frac{5}{8}$ inches is recommended. The rollers 26 and 28 allow the lift box 24 to roll along the rail 12 and allows the lift box to be easily moved into position. The lift box 24 is provided with a pulley mechanism 30 of a type well known in the art and can be either manual or automatic, depending upon the desired cost of resale. The pulley mechanism 30 must be heavy duty enough to lift the weight of the transmission. A transmission generally weighs between 1000–1500 pounds and mechanism sufficiently heavy duty to handle the weight without stress is recommended. It is imperative that the pulley mechanism 30 be provided with a locking device which prevents the transmission from falling once it is lifted. The pulley hook 40 is attached to the pulley mechanism 30 through use of a heavy weight cable 42. The lift box 24 is retained on the rail 12 through use of a pair of securing pins 32 which prevent the lift box 24 from lifting up off the rail 12. The securing pins 32 can be retained in position by any of the means described above. The end of the rail 12, opposite the end support 14, is provided with U brace 34 which has affixed thereto two lengths of chain 36. The lengths of chain 36 are secured to one another through use of a latch 38. As an alternative a heavy cable can be used to suspend the rail 12 from the support, as illustrated in FIG. 7. The cable is attached to the U brace 34 through looping through the U brace 34 and securing the cable on itself, or through other means as well known in the prior art. Another alternative is to use a U shaped rigid or semi-rigid support which is suspended over the support and attached to the U brace, as illustrated in FIG. 8, 34 through an adjustable locking device as well known in the prior art.

Figure 2:
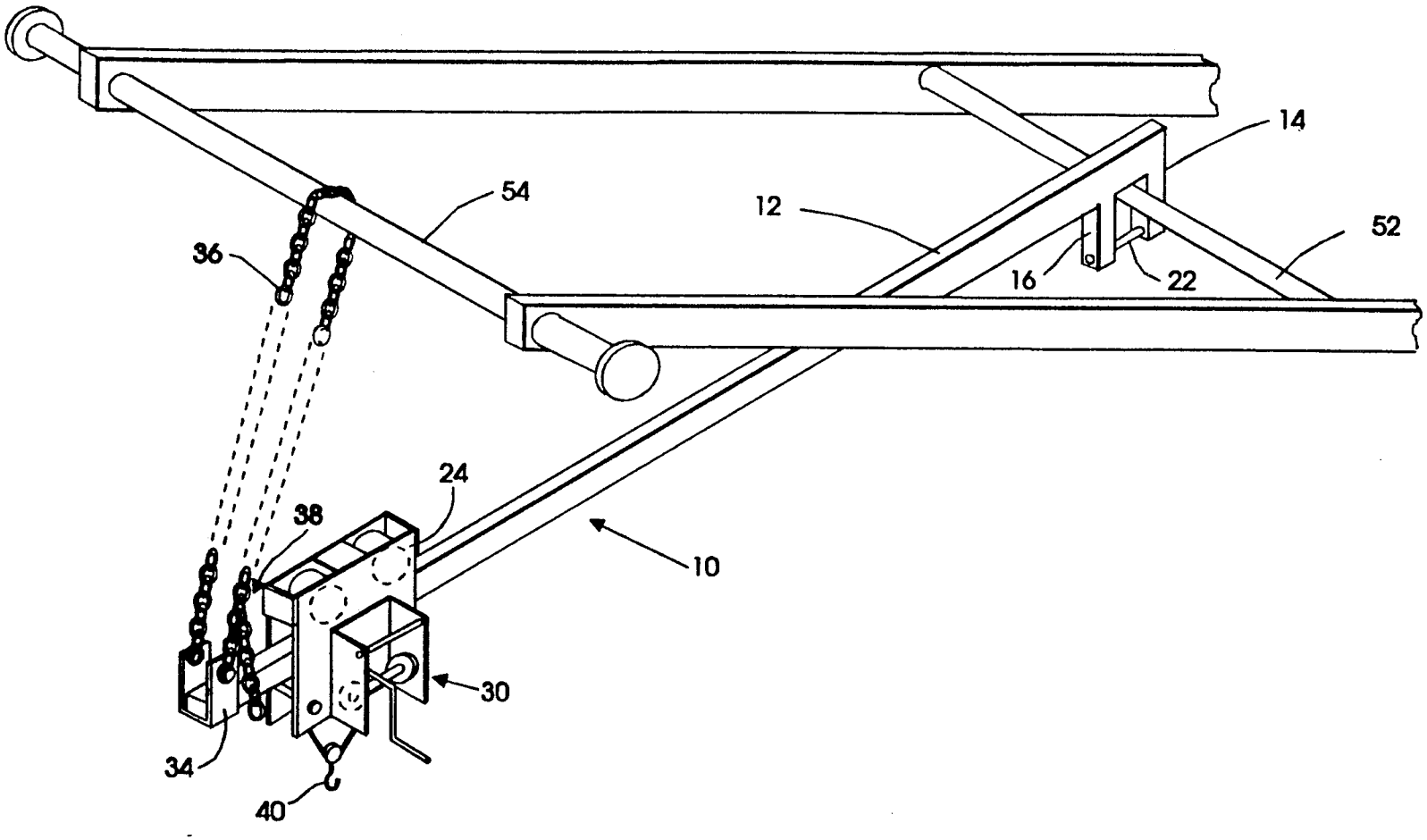
FIG. 2 is a perspective view of the device of FIG. 1 positioned for use.

In FIG. 2 the transmission lift 10 is in a position to remove the transmission from a truck. The end support 14 and accompanying end support 16 have been placed over the truck rear support 52 and secured with the pin 22. The chain 36 has been placed over the truck front support 54 and locked at an appropriate level through use of latch 38. The lift box 24 is placed in the desired location and the pulley hook 40 is lowered to come into contact with the truck transmission, through use of the pulley mechanism 30. Once secured to the pulley hook 40, the transmission is lifted out of the truck. Once clear of the truck, the transmission is moved aside, through use of rollers 26 and 28, to allow for easy access. The lift box 24 is secured to either the rear truck support 52 or other rigid device through means which are well known in the art, such as a chain or securing rod.

Figure 3:
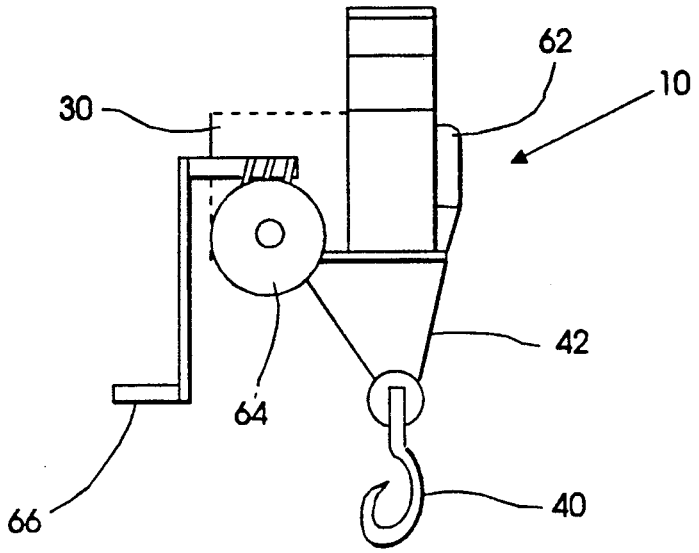
FIG. 3 is a front cutaway view of the transmission lift box of the instant disclosure.

In FIG. 3 a side view of the lift box 24 illustrates in more detail one of the pulley mechanisms 30 which can be used. The cable 42 is attached at one end to the lift cable hook up 62 and to the pulley roller 64 at the other end. The pulley roller 64 is rotated through use of the handle 66 to shorten the cable 42, thereby pulling the transmission up out of the truck engine. The pulley hook 40 is free to slide along the cable 42 as the transmission is raised.

Figure 4:
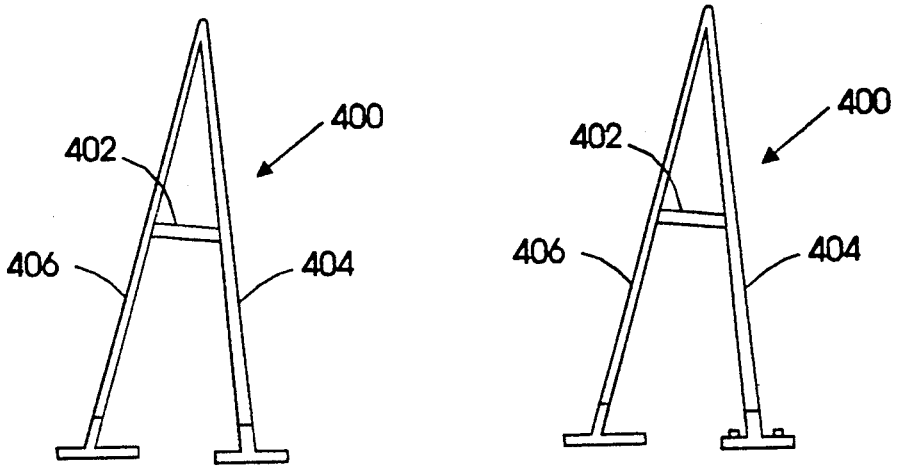
FIG. 4 is a perspective view of A frame supports for the instant invention.
Figure 5:
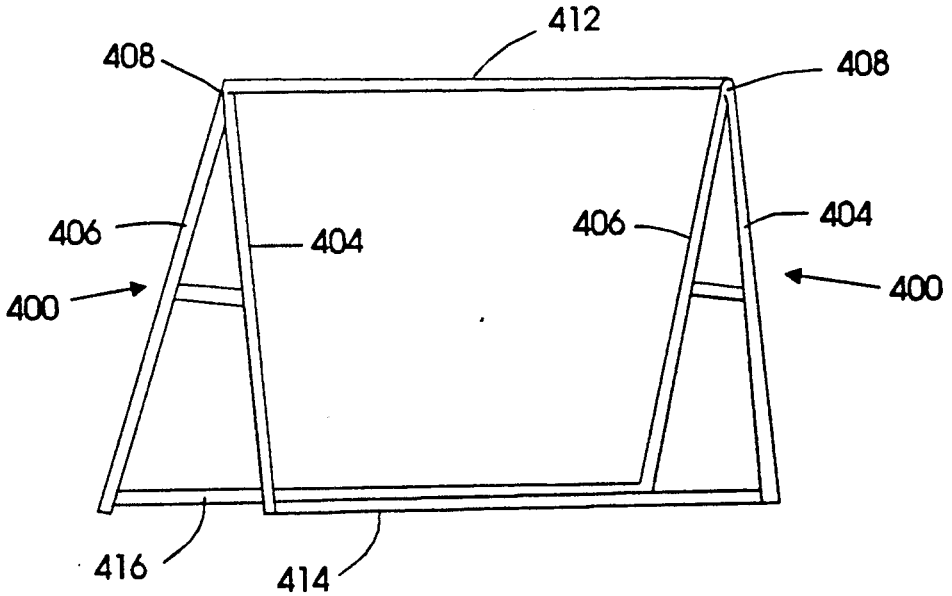
FIG. 5 is a perspective view of portable A frame supports connected to one another.

FIG. 4 illustrates a pair of freestanding A frames 400 which can be utilized with the instant device. The A frames 400 are spaced apart approximately the length of the rail 412. The end support 14 and accompanying support 16 are locked to the brace rail 402 as previously described in FIG. 1. The frame legs 404 and 406 are bolted to the floor, and optionally to the ceiling, to provide the required rigidity. In the event a fully mobile unit is required, the A frames 400 can be attached to one another through use of bracing bars 412, 414 and 418 at the legs 404 and 406 and the top of the A 408 as shown in FIG. 5.

Figure 6:
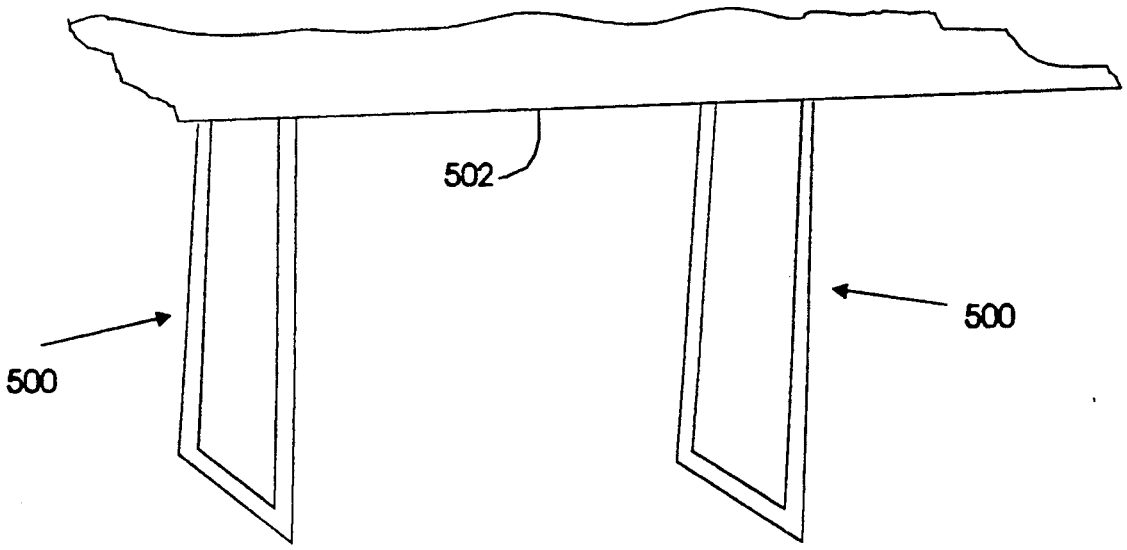
FIG. 6 is a perspective view of an alternate support for the device of FIG. 1.

As an alternative, braces 500 can be attached to the ceiling 502 of the workshop as illustrated in FIG. 6 and the transmission lift device 10 attached thereto.

The use of the device of FIG. 4 and the ceiling braces 500 allows the transmission lift device 10 to be used for repairs on items other than the body lift trucks. The transmission lift device 10 can be used to lift engines, etc. and is convenient for hydraulic valve body removal.

The dimensions and strengths used above are those preferred for body lift garbage trucks. They are not intended to limit the scope of the disclosure, only provide examples of dimensions and strengths which will provide the safety and endurance required. Other sizes which meet the requirements can be used.

What is claimed is:

1. A lifting device, said lifting device comprising a rail, said rail having a polygonal cross-section and having a first end and a second end;

a U shaped brace, said U shaped brace having a first end and a second end, said first end being affixed to said second end of said rail;

a U shaped support, said U shaped support being affixed to said first end of said rail and having at least one hanging means affixed thereto;

a movable lifting unit, said movable lifting unit having two panels and a plurality of rollers, said two panels straddling said rail and being in movable contact with said rail through said plurality of rollers;

braces, said braces connecting said two panels of said movable lifting unit keeping said panels at a predetermined distance from one another and providing rigidity;

a pulley system, said pulley system being affixed to said movable lifting unit;

wherein said rail is secured by said U shaped brace being placed over a first of a pair of supports and said at least one hanging means being placed over a second of a pair of supports, the movable lifting unit is moved over an item to be lifted and said item is lifted through use of said pulley system.

2. The lifting device of claim 1 wherein said rail is steel having a thickness of approximately 3/16 of an inch.

3. The lifting device of claim 1 wherein said rail has a square cross section.

4. The lifting device of claim 1 wherein said U shaped brace has securing means at said second end.

5. The lifting device of claim 4 wherein said securing means is a bolt, said bolt being placed through holes in said second end of said U shaped brace.

6. The lifting device of claim 1 wherein said pulley system further comprises hook means, said hook means being slideably attached to said pulley system by a wire, one end of said wire being affixed to said pulley system and the other end of said wire being affixed to said movable lifting unit.

7. The lifting device of claim 1 wherein said pulley system has a load lift capacity of at least 1000 pounds.

8. The lifting device of claim 1 wherein said movable lifting unit has removable securing means through said panels to prevent said movable lifting unit from inadvertently lifting from said rail.

9. The lifting device of claim 8 wherein said removable securing means are bolts.

10. The lifting device of claim 1 wherein said at least one hanging means is at least one chain, said at least one chain being affixed to said U shaped support at one end and having a fastening means at the other end.

11. The lifting device of claim 1 wherein said at least one hanging means is at least one wire, said at least one wire being affixed to said U shaped support at one end and having a fastening means at the other end.

12. The lifting device of claim 1 wherein said at least one hanging means is a U shaped support, said U shaped support being affixed to said U shaped brace by an adjustable locking device.

13. The lifting device of claim 1 wherein said pair of supports are a portion of a vehicle frame.

14. The lifting device of claim 1 wherein said pair of supports are a pair of A frame structures.

15. The lifting device of claim 14 wherein said pair of A frame structures are affixed to the floor.

16. The lifting device of claim 14 wherein said pair of A frame structures are connected to one another through brace means.

17. The lifting device of claim 1 wherein said pair of supports are affixed to the ceiling of a building.

18. The method of lifting a transmission from a vehicle wherein a lifting device is secured to at least a pair of support means, said lifting device having:

a rail, said rail having a polygon diameter and having a first end and a second end;

a U shaped brace, said U shaped brace having a first end and a second end, said first end being affixed to said second end of said rail and having securing means at said second end;

a U shaped support, said U shaped support being affixed to said first end of said rail and having at least one hanging means affixed thereto;

a movable lifting unit, said movable lifting unit having two panels, said two panels straddling said rail and being in movable contact with said rail through at least a pair of rollers;

braces, said braces connecting said two panels keeping said two panels at a predetermined distance from one another and providing rigidity; and a pulley system, said pulley system being affixed to said movable lifting unit and having hook means, said hook means being slideably attached to said pulley system by a wire, one end of said wire being affixed to said pulley system and the other end of said wire being affixed to said movable lifting unit; comprising the steps of securing said U shaped brace by said securing means to a first of said pair of support means, securing said U shaped support by said hanging means to a second of said pair of support means, moving said movable lifting unit into position over said transmission and securing said hook means from said pulley system to said transmission; lifting said transmission through the use of said pulley system from its position within said vehicle to a position clear of the vehicle; and moving said movable lifting unit along said rail to move said transmission away from said vehicle.

19. The method of lifting a transmission from a vehicle of claim 18 wherein said at least a pair of rollers are movably secured within said movable lifting unit to move along said rail and said transmission is moved by moving said movable lifting unit along said rail.

20. A lifting device, for use in lifting a transmission from a body lift vehicle, and said lifting device being secured to at least a pair of support means on the bottom of said body lift vehicle, said lifting device comprising:

a rail, said rail having a polygonal cross-section and having a first end and a second end;

a brace member, said brace member having a first end and a second end, said first end being affixed to said second end of said rail;

a support member, said support member being affixed to said first end of said rail and having at least one hanging means affixed thereto;

a movable lifting unit, said movable lifting unit having two panels and a plurality of rollers, said two panels straddling said rail and being in movable contact with said rail through said plurality of rollers;

a pulley system, said pulley system being affixed to said movable lifting unit;

said rail being secured by said brace member being placed over a first of said pair of support means on said vehicle, and at least one hanging means being placed over a second support means on said vehicle, wherein said movable lifting unit is moved over said transmission, said transmission is lifted from its mounting in said vehicle through use of said pulley system and said lifted transmission is moved to a second position.

* * * * *